United States Patent [19]

Ruhe et al.

[11] 4,308,914

[45] Jan. 5, 1982

[54] DOUBLE PLATE FLOW DISTRIBUTOR

[76] Inventors: Anthony Ruhe, 1310 Pelham Rd., Box 791, Fonthill, Ontario, Canada, L0S 1E0; James H. D. Nickerson, 414 Gowland Cres., Milton, Ontario, Canada, L9T 4E4

[21] Appl. No.: 35,872

[22] Filed: May 3, 1979

[30] Foreign Application Priority Data

Mar. 19, 1979 [CA] Canada ..... 323743

[51] Int. Cl.[3] ..... F22B 1/06; F28F 9/22

[52] U.S. Cl. ..... 165/160; 122/32

[58] Field of Search ..... 165/158–161; 122/32, 34

[56] References Cited

U.S. PATENT DOCUMENTS

| | | | |
|---|---|---|---|
| 3,437,077 | 4/1969 | Ammon et al. | 122/32 |
| 3,915,123 | 10/1975 | Reisacher | 165/160 X |
| 4,131,085 | 12/1978 | McDonald | 122/32 X |

*Primary Examiner*—Samuel Scott
*Assistant Examiner*—Theophil W. Streule, Jr.
*Attorney, Agent, or Firm*—Marvin A. Naigur; John E. Wilson; John J. Herguth, Jr.

[57] ABSTRACT

A U-tube type heat exchanger is provided with means for uniformly distributing shell side fluid across the lateral expanse of the tube bundle. The distributor means includes first and second upstanding plates between which are connected several ribs.

6 Claims, 4 Drawing Figures

DOUBLE PLATE FLOW DISTRIBUTOR

BACKGROUND OF THE INVENTION

This invention relates to U-tube type heat exchangers, and more particularly, to nuclear steam generators. In U-tube type heat exchangers a first heat exchange fluid is passed into a shell within which a bundle of U-shaped tubes is disposed. Simultaneously a second heat exchange fluid is passed through the tubes. As the first fluid passes over the outer surfaces of the tubes it comes in an indirect heat exchange relation with the second fluid that is passing through the tubes. When the second fluid is at a higher temperature than the first fluid the first fluid is thereby heated, and a portion of the first fluid is converted to vapor. Heated first fluid rises within the heat exchanger, and the vapor is thereafter separated from the liquid phase of the heated first fluid. The liquid phase of the heated first fluid is recirculated within the shell, being returned to the lower portion of the steam generator through a downcomer space defined between the inner wall of the heat exchanger shell and the outer wall of a shroud disposed around the tube bundle. In U-tube type heat exchangers, and especially in nuclear steam generators, the tubes are usually arranged in a closely packed bundle. Due to the close spacing of the tubes, the recirculating first fluid does not always penetrate the tube bundle uniformly. As a result poor thermal hydraulic conditions exist in a region of the tube bundle located just above the tubesheet to which the ends of the U-tubes are attached.

The present invention provides a double plate flow distributor that serves to improve recirculation of the first, or shell side, fluid through the tube bundle and thereby avoids the poor thermal hydraulic conditions associated with U-tube type heat exchangers.

SUMMARY OF THE INVENTION

In accordance with an illustrative embodiment demonstrating features and advantages of the present invention, there is provided a U-tube type heat exchanger including a plurality of U-shaped tubes disposed within a cylindrical shell section. First and second plates are disposed between the upflow and downflow legs of the tubes, and are connected along their upper edges by a horizontally extending member. A plurality of ribs are connected between the plates, and serve to direct shell side fluid across the lateral expanse of the tube bundle. As a result a more uniform distribution of shell side fluid is achieved.

DESCRIPTION OF THE PREFERRED EMBODIMENT

Figure 1:
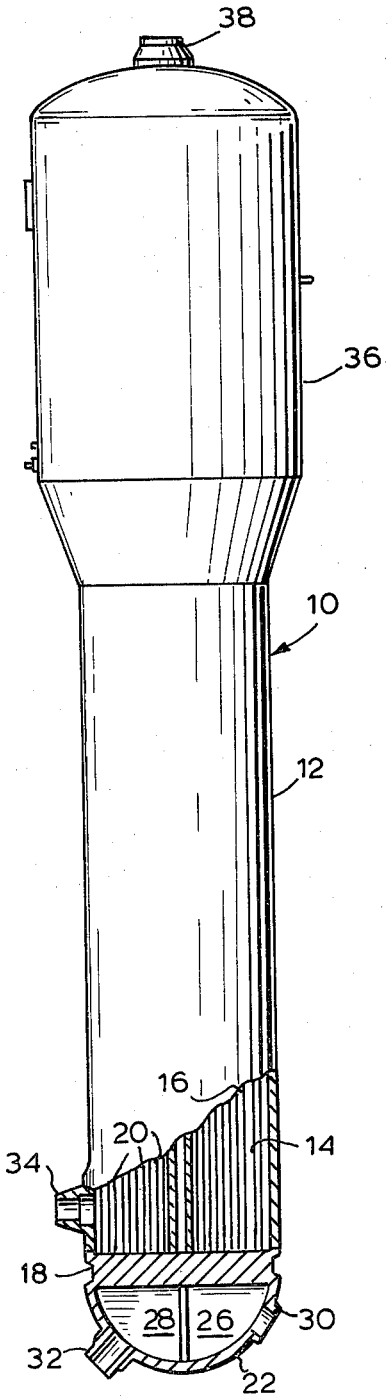
FIG. 1 is an elevational view of a nuclear steam generator incorporating the double plate flow distributor of the present invention.

Referring to FIG. 1 there is shown a nuclear steam generator 10 which includes a cylindrical shell section

12 within which a bundle of U-shaped tubes 14 are disposed. Tubes 14 include upflow legs 16 communicating with tubesheet 18 at one end and downflow legs 20 communicating with tubesheet 18 at other ends thereof. A header 22 is attached to the underside of tube-sheet 18, and together with the underside of tubesheet 18 and a partition plate 24 defines an inlet chamber 26 and an outlet chamber 28. An inlet 30 is provided for introducing a heat exchange fluid, such as water, or heavy water, into inlet chamber 26; this fluid is referred to as tube side fluid. Similarly an outlet 32 is provided for removal of the tube side heat exchange fluid from outlet chamber 28. An inlet 34 is provided for introducing another heat exchange fluid, referred to as shell side fluid, into shell 12. The shell side heat exchange fluid which could be water, for example, passes over the outer surfaces of tubes 14, and a portion of the fluid is vaporized. The heated shell side fluid thereafter rises into the upper section 36 above section 12 within which separators (not shown) are disposed for separating the vapor from the heated fluid. The vapor is ultimately removed from the steam generator 10 through outlet 38.

Figure 2:
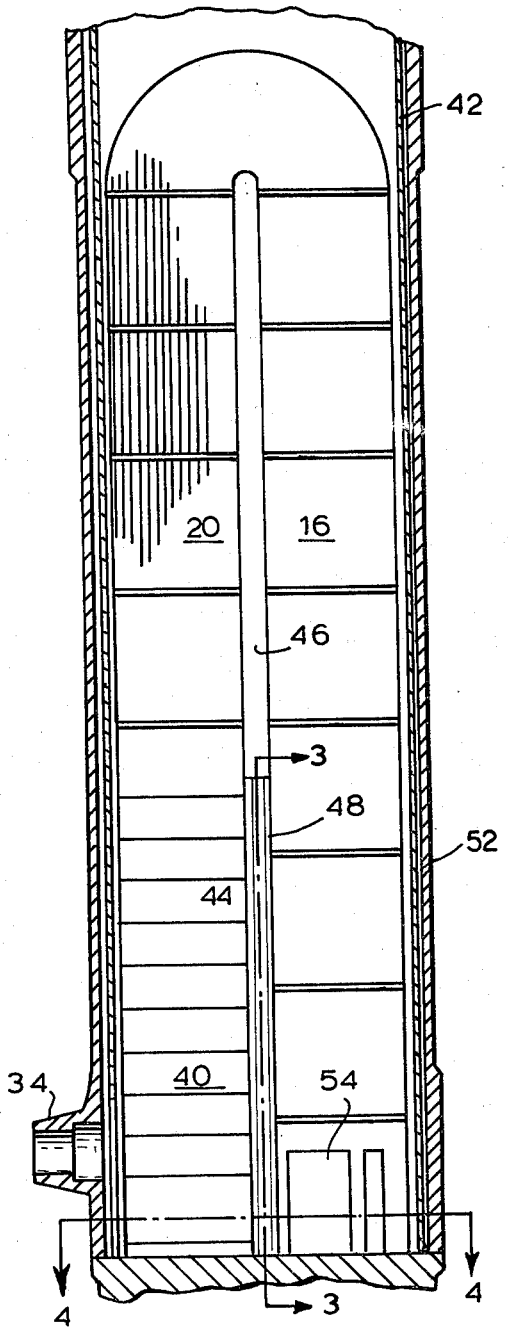
FIG. 2 is a sectional view of a portion of the steam generator shown in FIG. 1.

Turning to FIG. 2, a more detailed sectional view of the cylindrical shell section 12 of steam generator 10 is shown. Adjacent inlet 34 is a preheat or economizer zone 40. The economizer zone 46 is defined by the inner wall of a generally semicylindrical section of shroud 42 and a first plate 44. Plate 44 extends across diametral tube-free zone 46 formed between upflow leg 16 and downflow legs 20 of U-tubes 14, and is welded to shroud 42 along its side edges. A second plate 48 is also disposed within zone 46, being closer to upflow legs 16 than is first plate 44. Plate 48 is also welded to shroud 42, as will be discussed later, but extends beyond shroud 42 to shell 12. Slots are formed in shroud 42 so as to allow recirculating shell side fluid to enter zone 46 between plates 44, 48. The extensions of plate 48 serve to direct recirculating fluid into zone 46. Plates 44 and 48 are attached to the upper surface of tubesheet 18 along their respective lower edges. An annular downcomer space 52 is defined between the outer surface of shroud 42 and the inner wall of shell 12. Windows or openings 54 are formed in shroud 42 adjacent the upper surface of tubesheet 18. Recirculating shell side fluid passes from downcomer space 52 into the tube bundle through windows 54.

Figure 3:
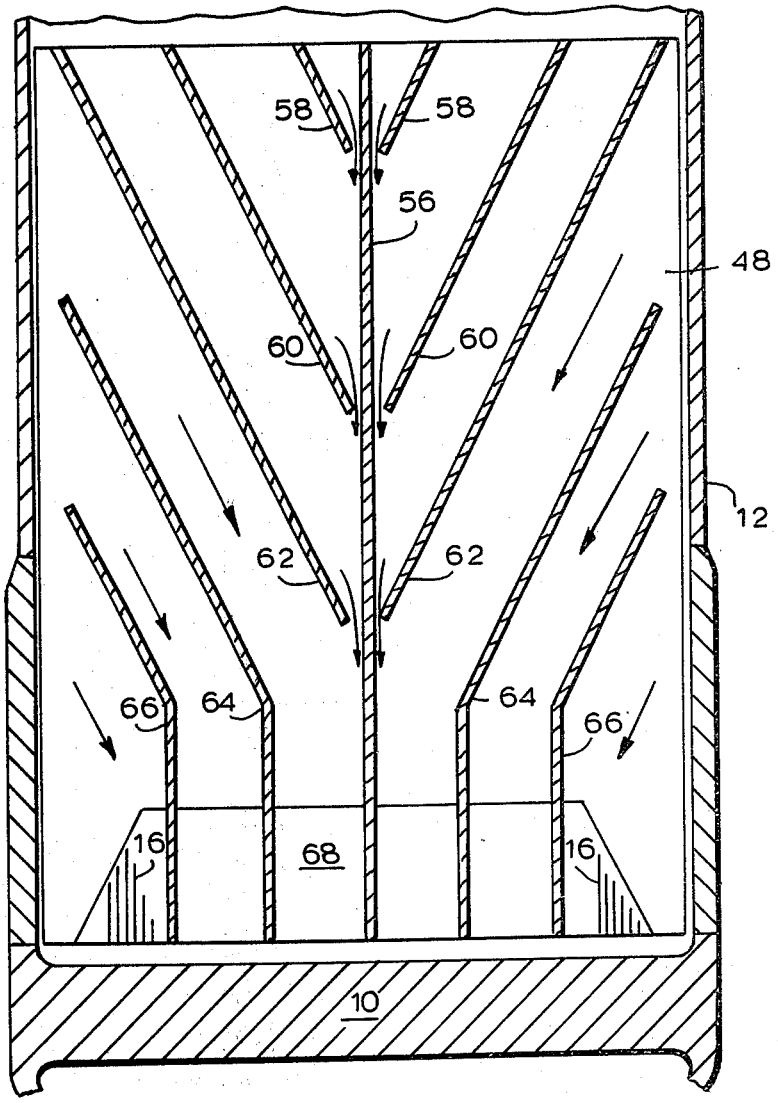
FIG. 3 is a sectional view taken along line 3—3 of FIG. 2 showing the ribs of the double plate flow distributor.

Turning now to FIG. 3, a plurality of ribs 56, 58, 60, 62, 64 and 66 are attached between plates 44 and 48. These ribs serve to direct that portion of the recirculating shell side fluid across zone 46. These ribs also provide structural integrity to the double plate distributor, making the combination of plates and ribs much stronger than the single partition plate ordinarily employed for sealing the economizer zone from the boiling zone of the steam generator. A window 68 is formed in plate 48 adjacent the upper surface of tubesheet 18. After the recirculating shell side fluid passes within zone 46 between ribs 56–66, it empties into the tube bundle through window 68 passing over upflow legs 16 of tubes 14. As a result, more uniform distribution of shell side fluid across the outer surfaces of legs 16 is achieved. Ribs 56, 64 and 66 each include vertically extending sections. The vertically extending sections serve to distribute recirculating shell side fluid across the entire lateral expanse of the tube bundle.

Figure 4:
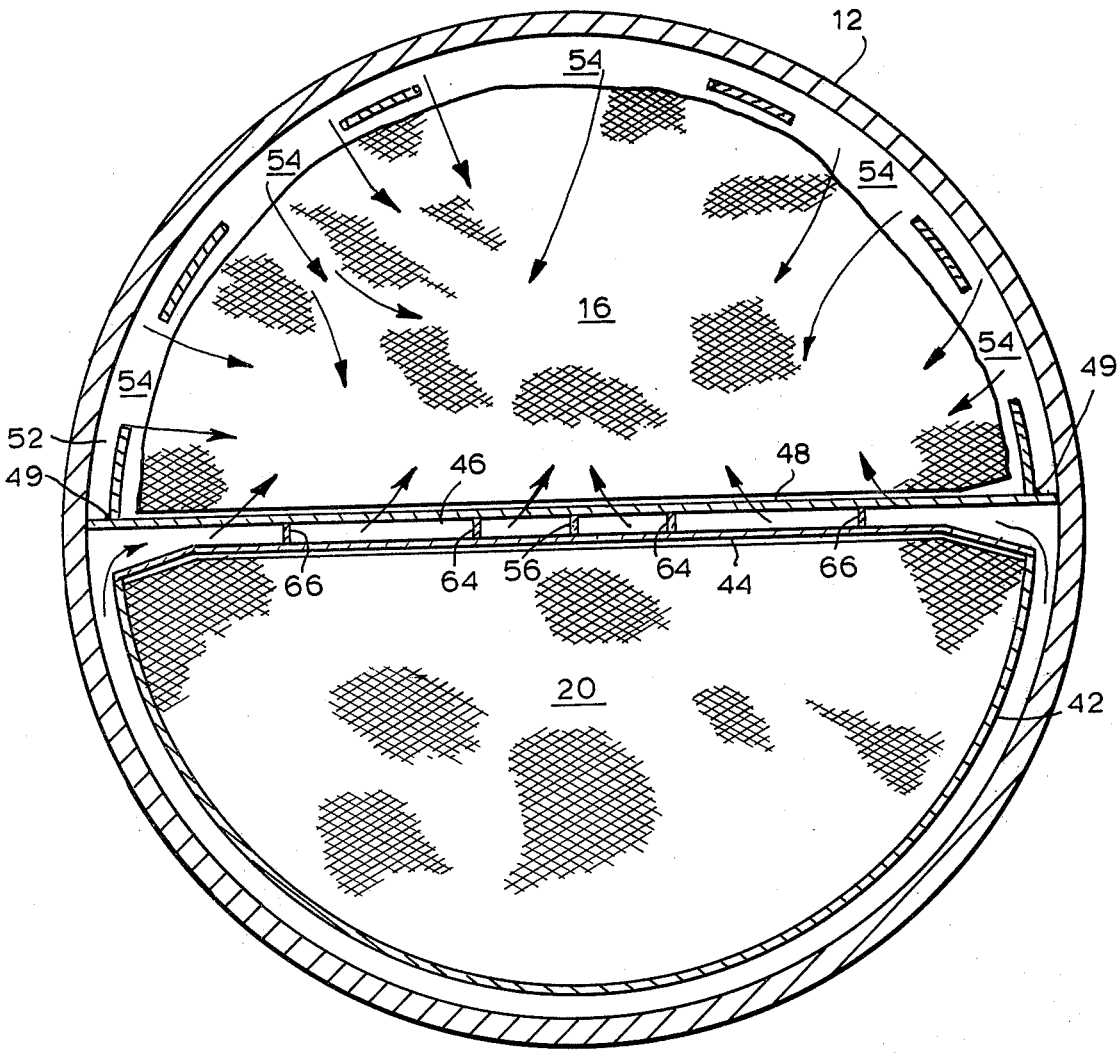
FIG. 4 is a plan view taken along line 4—4 of FIG. 2 showing the annular downcomer space communicating with the double plate flow distributor of the invention.

Turning to FIG. 4, a plan view taken along line 4—4 of FIG. 2 is shown. Arrows indicate the direction of flow of recirculating shell side fluid through annular downcomer space 52 into diametral zone 46, and through windows or openings 68. Arrows also indicate the direction of flow of recirculated shell side fluid from annular space 52 through windows 54 into the tube bundle. As can be seen in this figure, plate 48 is welded to shroud 42 along seams 49, and the extension of plate 48 beyond shroud 42 adjacent the inner wall of shell 12 serves to direct recirculating shell side fluid into zone 46.

In operation a first heat exchanger fluid such as water is introduced through inlet 34 into the economizer zone 40 of steam generator 10. Simultaneously a second relatively hotter heat exchange fluid as heavy water is introduced through inlet 30 into chamber 26. The second fluid rises through upflow legs 16, returns through downflow legs 20 into outlet chamber 28, and is removed through outlet 32 from steam generator 10. The heat exchange fluid, also known as the shell side fluid, passes over the outer surfaces of downflow leg 20, coming in indirect heat exchange contact with the hotter fluid flowing through leg 20. The shell side fluid is thereby heated and rises within shell 12. The heated shell side fluid passes into upper section 36 whereat the vapor phase of the shell side fluid, such as steam, is separated from the liquid phase. The vapor phase is removed through outlet 38 and the liquid phase is recirculated through annular downcomer space 52. Some of the recirculating shell side fluid passes through slots formed in shroud 42 into a diametral zone 46. This portion of the recirculated fluid is directed over ribs 56–66 which distribute the fluid across the lateral expanse of zone 46. This fluid is thereafter passed through window 68 across the upflow legs 16 of tubes 14. Another portion of the recirculated shell side fluid passes down annular space 52 and then through windows 54 into the bundle of tubes 14. As a result shell side fluid penetrates the bundle of upflow legs 16 from the outer periphery of the bundle and from the central diametral zone 46 so as to achieve more uniform distribution of the fluid.

A latitude of modification, change and substitution is intended in the foregoing disclosure and in some instances some features of the invention will be employed without a corresponding use of other features. Accordingly, it is appropriate that the appended claims be construed broadly and in a manner consistent with the scope and spirit of the invention herein.

The embodiments of the invention in which an exclusive property or privilege is claimed are defined as follows:

1. A heat exchanger, comprising a cylindrical section; a tubesheet rigidly secured to said shell section; a bundle of U-shaped tubes disposed within said shell section, said tubes including upflow and downflow legs connected to said tubesheet, said upflow legs being spaced apart from said downflow legs so as to define a diametral tube-free zone therebetween; a cylindrical shroud disposed coaxially within said shell around said tube bundle said shroud together with said shell section defining an annular space therebetween; means for introducing a first fluid into said shell; means for removing said first fluid from said shell; means for passing said first fluid into said tube-free zone, said means for passing including a first plate extending through said zone and rigidly connected to said shroud along its side edges, said first plate being adjacent said downflow legs of said U-shaped tubes, a second plate extending through said zone and spaced away from said first plate, said second plate being adjacent said upflow legs of said U-shaped tubes and rigidly connected to said shroud, said second plate contacting the inner wall of said shell section at opposite ends thereof, and a plurality of ribs connected between said plates, said shroud being formed with openings therethrough to permit passage of said first fluid from said annular space into said tube-free zone between said plates, said openings extending above and below at least one of said ribs to permit passage of said first heat exchange fluid into said tube-free zone above and below said one rib, said ribs including vertically extending sections connected to sloped sections sloping in a direction extending upwardly from the center of said heat exchanger toward said shell section, said vertical sections being spaced apart from one another so as to allow for distribution of said first fluid along the length of said tube-free zone and across said tubesheet therebelow, and means for directing said fluid from said tube-free zone toward said upflow legs of said U-shaped tubes, said means for directing including an opening formed in said second plate and extending substantially across the lateral expanse of said second plate.

2. A vapor generator comprising a vertically extending cylindrical shell section; a tubesheet rigidly secured to said shell section adjacent the lower end thereof, a bundle of U-shaped tubes disposed within said shell section, said tubes including respective upflow and downflow legs connected to said tubesheet, said upflow legs being spaced apart from said downflow legs so as to define a diametral tube-free zone therebetween, means for introducing a first heat exchange fluid into said shell, means for removing said first heat exchange fluid from said shell, means for introducing a second heat exchange fluid into said upflow legs, means for removing said second heat exchange fluid from said downflow legs, a cylindrical shroud disposed coaxially within said shell section surrounding said tube bundle said shroud together with said shell section defining an annular space therebetween, means for passing said first heat exchange fluid into said tube-free zone, said means for passing including a first plate extending through said zone and rigidly connected to said shroud along its side edges, said first plate being adjacent said downflow legs of said U-shaped tubes, a second plate extending through said zone and spaced away from said first plate, said second plate being adjacent said upflow legs of said U-shaped tubes and rigidly connected to said shroud, said second plate contacting the inner wall of said shell section at opposite ends thereof, and a plurality of ribs connected between said plates, said shroud being formed with openings therethrough to permit passage of said first fluid from said annular space into said tube-free zone between said plates, said openings extending above and below at least one of said ribs to permit passage of said first heat exchange fluid into said tube-free zone above and below said one rib, said ribs including vertically extending sections connected to sloped sections sloping in a direction extending upwardly from the center of said vapor generator toward said shell section, said vertical sections being spaced apart from one another to allow for distribution of said first fluid along the length of said tube-free zone and across said tubesheet therebelow, and means for directing said first heat exchange fluid from said tube-free zone toward said upflow legs of said U-shaped tubes, said means for directing including an opening formed in said second plate and extending substantially across the lateral expanse of said second plate.

3. The vapor generator of claim 2 wherein said means for introducing said second heat exchange fluid to said upflow legs comprises means for introducing heavy water into said upflow legs, and wherein said means for introducing a first heat exchange fluid into said shell comprises means for introducing water into said shell.

4. The vapor generator of claim 2 further comprising preheat and boiling zone, said boiling zone comprising the lower portion of said shell section between the upper surface of said tubesheet, and the upper edge of said first plate, said first heat exchange fluid being heated within said preheat zone to a saturated vapor as said first heat exchange fluid passes over the lower sections of said downflow legs of said U-shaped tubes.

5. The heat exchange of claim 1 wherein said means for introducing a first fluid into said shell comprises an inlet formed in said shell, said inlet being adjacent the upper face of said tubesheet and adapted to introduce said first heat exchange fluid into said shell adjacent said downflow legs of said U-shaped tubes.

6. The vapor generator of claim 2 wherein said means for introducing a first heat exchange fluid into said shell comprises an inlet formed in said shell adjacent the upper face of said tubesheet, said inlet being adapted to introduce said first heat exchange fluid adjacent said downflow legs of said U-shaped tubes.

* * * * *